US008662660B2

(12) United States Patent
Wu

(10) Patent No.: US 8,662,660 B2
(45) Date of Patent: Mar. 4, 2014

(54) PRINTER

(75) Inventor: Chun-I Wu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 181 days.

(21) Appl. No.: 13/326,418

(22) Filed: Dec. 15, 2011

(65) Prior Publication Data

US 2012/0268540 A1 Oct. 25, 2012

(30) Foreign Application Priority Data

Apr. 25, 2011 (TW) ..... 10114343 A

(51) Int. Cl.
*B41J 2/01* (2006.01)
*B41J 23/00* (2006.01)

(52) U.S. Cl.
USPC ..... 347/104; 347/37

(58) Field of Classification Search
None
See application file for complete search history.

(56) References Cited

U.S. PATENT DOCUMENTS

2004/0207707 A1* 10/2004 Ohashi et al. ..... 347/104
2006/0192798 A1* 8/2006 Kuki et al. ..... 347/8
2008/0309734 A1* 12/2008 Nishimura et al. ..... 347/70
2009/0058891 A1* 3/2009 Kershisnik et al. ..... 347/2
2010/0201743 A1* 8/2010 Miyata ..... 347/37

* cited by examiner

*Primary Examiner* — Stephen Meier
*Assistant Examiner* — Alexander C Witkowski
(74) *Attorney, Agent, or Firm* — Altis Law Group, Inc.

(57) ABSTRACT

A printer includes a jet and an adjusting device. The adjusting device includes a base, a movable rod on the base, and an idle roller secured to the movable rod. The idle roller drives a piece of paper to slide. A feed roller is secured above the idle roller, and a gap between the feed roller and the idle roller has a gap height accommodating a paper thickness. A driving mechanism is in a side of the idle roller and transports the piece of paper out of the gap. During a printing process, the feed roller faces a printed side, and the idle roller faces an opposite side. The jet is secured above the printed side and between the driving mechanism and the feed roller. The idle roller moves substantially perpendicular to a printing surface, and the idle roller adjusts the gap height substantially equal to the paper thickness.

19 Claims, 4 Drawing Sheets

PRINTER

BACKGROUND

1. Technical Field

The present disclosure relates to printers, and particularly a inkjet printer.

2. Description of Related Art

An inkjet printer includes a jet. Ink sprays from the jet to print on a piece of paper. The printer must maintain a certain distance between the jet and a printing surface of the piece of paper to ensure the quality of printing. The piece of paper may be slid between an idle roller and a feed roller. However, the distance between the jet and the printing surface of pieces of paper of different types are different because of the different thicknesses of the pieces of paper, which may affect the quality of printing. Therefore, an improved ink jet printer may be desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
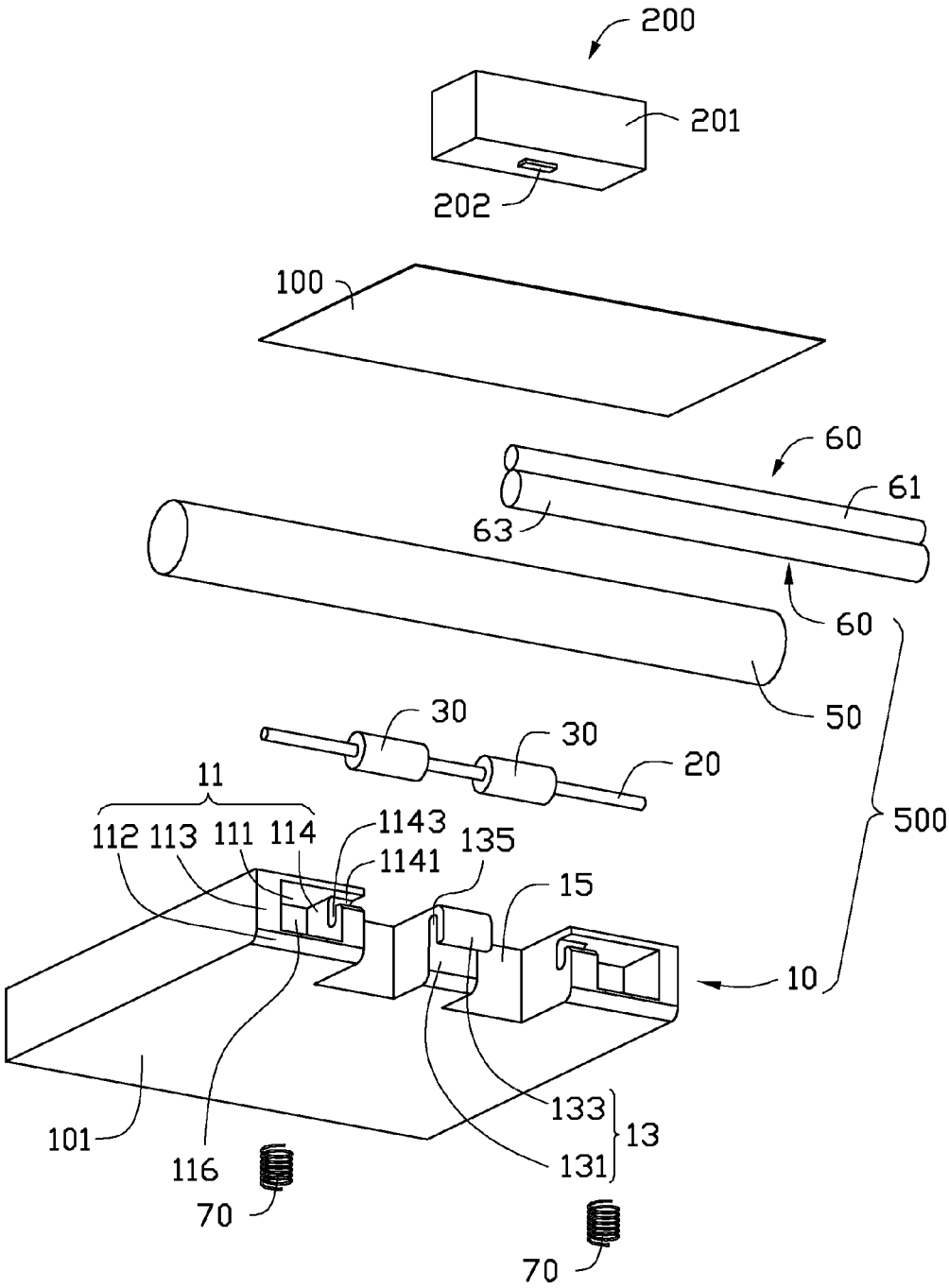
FIG. 1 is an exploded, isometric view of one embodiment of an adjusting device and a paper of a printer.

Referring to FIG. 1, a printer in accordance with an embodiment comprises an adjusting device 500 for adjusting a distance between a piece of paper 100 and an ink spraying system 200. The piece of paper 100 may has a first thickness or a second thickness greater than the first thickness. The adjusting device comprises a base 10, a movable rod 20, two idle rollers 30, a feed roller 50 and a driving mechanism 60.

The base 10 comprises a body 101, two mounting brackets 11 and a positioning portion 13 extending from a side surface of the body 101. The positioning portion 13 is located between the two mounting brackets 11. A receiving section 15 is defined between the positioning portion 13 and each of the two mounting brackets 11. The receiving section 15 receives the two idle rollers 30. Each of the two mounting brackets 11 comprises a top wall 111, a bottom all 112, a first sidewall 113, and a second sidewall 114 opposite to the first sidewall 113. The top wall 111, the bottom all 112, the first sidewall 113 and the second sidewall 114 are substantially perpendicular to the side surface of the body 101 and together define a receiving space 116. The bottom wall 112 defines a slot (not shown) for receiving a resilient member 70. The second sidewall 114 defines a cutout 1141 and a sliding slot 1143. The cutout 1141 and the sliding slot 1143 communicate with the receiving space 116. The cutout 1141 communicates with the sliding slot 1143. The positioning portion 13 comprises a connecting end 131 and a limiting end 133. The connecting end 131 extends from the body 101. The limiting end 133 extends downwards from a top portion of the connecting end 131. A limiting slot 135 is defined between the connecting end 131 and the limiting end 133.

The two idle rollers 30 are secured to the movable rod 20. In one embodiment, the cross-sections of the movable rod 20 and the two idle rollers 30 are round. A diameter of each of the two idle rollers 30 is greater than that of the movable rod 20.

The feed roller 50 together with the two idle rollers 30 transfers the piece of paper 100. In one embodiment, a cross-section of the feed roller 50 is round.

The driving mechanism 60 carries the piece of paper 100 from the two idle rollers 30 and the feed roller 50. The driving mechanism 60 comprises a first roller 61 and a second roller 63. In one embodiment, a cross-section of the first roller 61 and the second roller 63 is round. The diameter of the second roller 63 is greater than that of the first roller 61.

The ink spraying system 200 comprises a ink case 201 and a jet 202.

Figure 2:
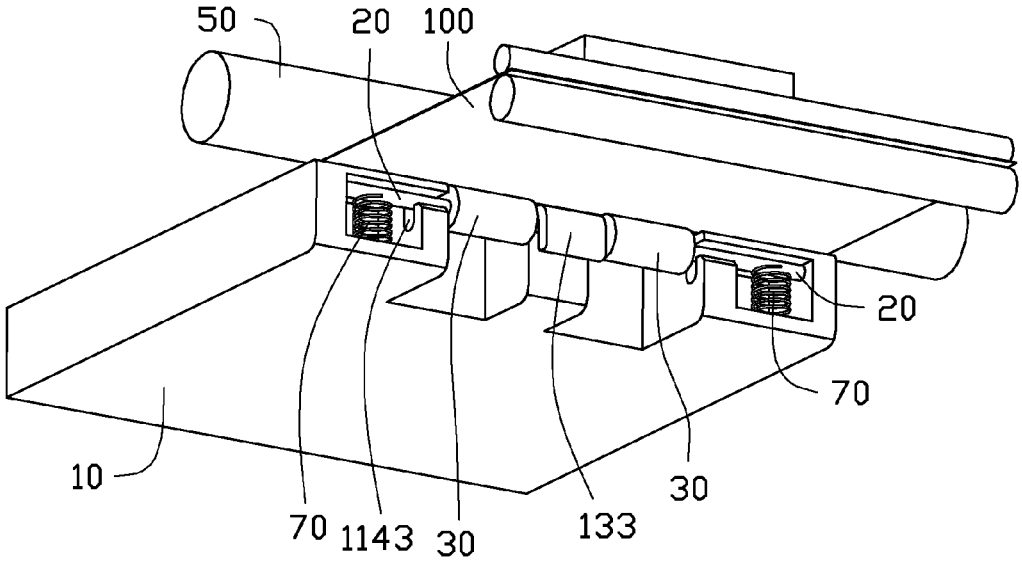
FIG. 2 is an isometric assembled view of the adjusting device and the paper of FIG. 1, and the paper has a first thickness.
Figure 3:
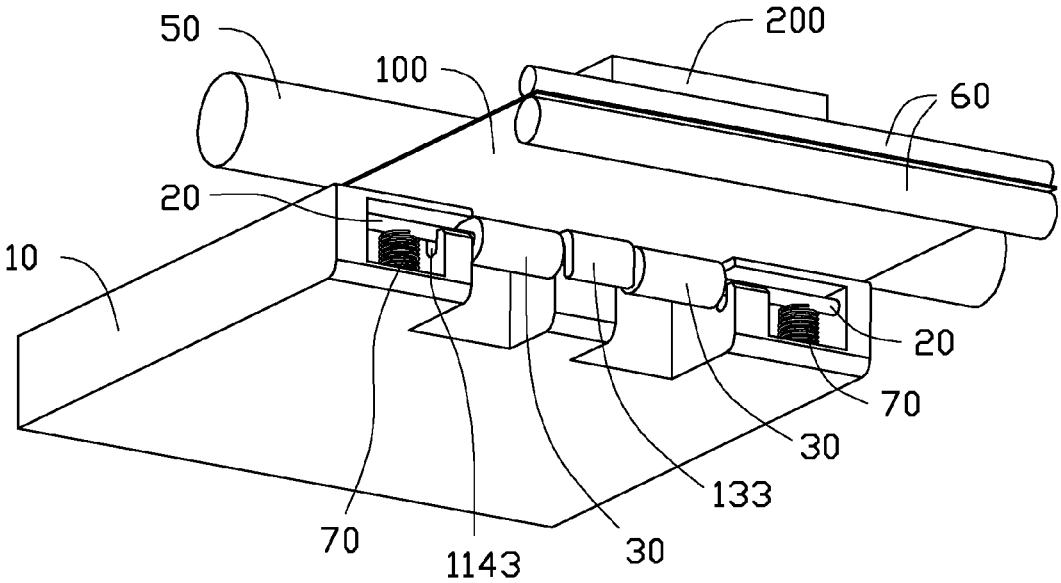
FIG. 3 is similar to FIG. 2, but the paper has a second thickness.
Figure 4:
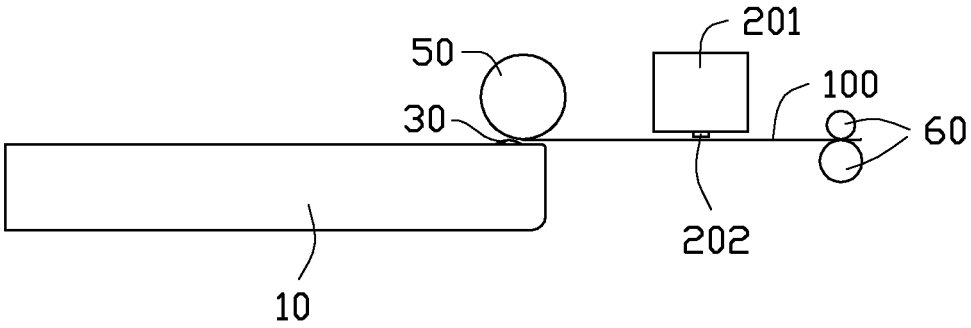
FIG. 4 is a side view of the assembled adjusting device and the paper of FIG. 2.

Referring to FIGS. 2-4, in assembly, the resilient member 70 is secured to the slot of the bottom wall 112. The two idle rollers 30 and the movable rod 20 are moved below the limiting end 133, and each of the two idle rollers 30 is aligned with the receiving section 15. The movable rod 20 is placed into the limiting slot 135 and is moved upwards, and then the movable rod 20 is received in the sliding slot 1143 through the cutout 1141. Two opposite ends of the movable rod 20 abut against the resilient member 70. The feed roller 50 is secured above a top surface of the body 101 and the two idle rollers 30. A first gap is defined between the feed roller 50 and the two idle rollers 30, for the piece of paper 100 to pass through. The two idle rollers 30 are exposed out of a top surface of the body 101, which is substantially perpendicular to the side surface. The driving mechanism 60 is secured to outside of the base 10, a second gap is defined between the first roller 61 and the second roller 63, for the piece of paper 100 to pass through. The ink spraying system 200 is located between the feed roller 50 and the driving mechanism 60.

During the work process, the piece of paper 100 is slid into the first gap between the two idle rollers 30 and the feed roller 50 from the top surface of the body 101. Referring to FIG. 2, when the piece of paper 100 has the first thickness, the piece of paper 100 abuts the two idle rollers 30 and drives the movable rod 20 to move downwards along the sliding slot 1143. The two idle rollers 30 elastically deform the resilient member 70. The resilient member 70 has a first length. Referring to FIG. 3, when the piece of paper 100 has the second thickness, the piece of paper 100 abuts the two idle rollers 30 and drives the movable rod 20 to move downwards along the sliding slot 1143. The two idle rollers 30 elastically deform the resilient member 70. The resilient member 70 has a second length, which is greater than the first length. The first gap is enlarged for the piece of paper 100 having a second thickness to pass through, and the height of the first gap is substantially equal to the thickness of the piece of paper 100. The piece of paper 100 is slid out of the first gap and is slid into the second gap between the first roller 61 and the second roller 63 below the jet 202. A top surface of the piece of paper 100 is tangency with the feed roller 50. A bottom surface of the piece of paper 100 opposite to the top surface is tangency with the two idle rollers 30. The locations of the jet 202 and the feed roller 50 are fixed, then the distance between the top surface of the piece of paper 100 and the jet 202 is fixed. The jet 202 sprays ink to the top surface of the piece of paper 100 to print.

It is to be understood, however, that even though numerous characteristics and advantages have been set forth in the foregoing description of embodiments, together with details of the structures and functions of the embodiments, the disclosure is illustrative only and changes ay be made in detail, especially in the matters of shape, size, and arrangement of parts within the principles of the disclosure, to the full extent indicated by the broad general meaning of the terms in which the appended claims are expressed.

What is claimed is:

1. A printer comprising:

a jet; and an adjusting device, the adjusting device comprising:

a base;

a movable rod mounted to the base;

an idle roller secured to the movable rod, the idle roller moves with the movable rod, and the idle roller is adapted to drive a piece of paper to slide;

a feed roller secured above the idle roller, and a gap defined between the feed roller and the idle roller, and the gap has a height accommodating a thickness of the piece of paper sliding through; and a driving mechanism secured in a side of the idle roller, and is adapted to transport the piece of paper out of the gap between the idle roller and the feed roller;

wherein during a printing process, the feed roller faces a side of the piece of paper that is being printed, and the idle roller faces an opposite side of the piece of paper; the jet is secured above the side that is being printed, and is located between the driving mechanism and the feed roller; the idle roller moves along a direction substantially perpendicular to a printing surface of the piece of paper, and the idle roller adjusts the height of the gap substantially equal to the thickness of the piece of paper;

wherein the adjusting device further comprises a resilient member secured to the base, the idle roller abuts the resilient member, and the resilient member is elastically deformable along the direction substantially perpendicular to the printing surface.

2. The printer of claim 1, wherein when a piece of paper has a first thickness, the resilient member is elastically deformed to a first length; when another piece of paper has a second thickness greater than the first thickness, the resilient member is elastically deformed to a second length shorter than the first length.

3. The printer of claim 1, wherein the base comprises a body, a mounting bracket and a positioning portion, the mounting bracket and the positioning portion extend from a side surface of the body, and the idle roller is received between the mounting bracket and the positioning portion.

4. The printer of claim 3, wherein the resilient member is secured in a receiving space of the mounting bracket; wherein the receiving space is defined by a top wall, a bottom wall, a first sidewall, and a second side wall of the mounting bracket; the bottom wall is opposite the top wall, and the second sidewall opposite to the first sidewall.

5. The printer of claim 4, wherein the mounting bracket defines a sliding slot and a cutout, the cutout communicates with the sliding slot, and the movable rod is slidably received in the sliding slot through the cutout.

6. The printer of claim 5, wherein the cutout and the sliding slot communicate with the receiving space.

7. The printer of claim 5, wherein the positioning portion comprises a connecting end and a limiting end, the connecting end extends from the body, and the limiting end extends from a top portion of the connecting end; a limiting slot is defined between the limiting end and the connecting end, the movable rod is received in the limiting slot and is blocked by the limiting end from moving out of the cutout.

8. The printer of claim 3, wherein the idle roller exposes out of a top surface of the body, which is substantially perpendicular to the side surface, and the piece of paper is slid in the gap from the top surface of the body.

9. The printer of claim 1, wherein a circumferential surface of the feed roller is tangent with the side of the piece of paper that is being printed, and a circumferential surface of the idle roller is tangent with the opposite side of the piece of paper.

10. A printer comprising:

a jet; and an adjusting device, the adjusting device comprising:

a base;

a resilient member secured to the base;

a movable rod movably mounted to the base and abutting the resilient member;

an idle roller secured to the movable rod, the idle roller moves with the movable rod, and idle roller is adapted to drive a piece of paper to slide;

a feed roller secured above the idle roller, and a gap defined between the feed roller and the idle roller, and the gap has a height accommodating for a thickness of the piece of paper sliding through; and a driving mechanism secured in a side of the idle roller, and is adapted to transport the piece of paper out of the gap between the idle roller and the feed roller;

wherein the jet is secured above a printing surface of the paper and located between the driving mechanism and the feed roller; the feed roller faces the side of the piece of paper that is being printed, and the idle roller faces an opposite side of the piece of paper; the resilient member is elastically deformable away from the piece of paper and drives the idle roller and the movable rod to move along a direction substantially perpendicular to the printing surface, and a circumferential surface of the feed roller is tangent with the printing surface of the piece of paper.

11. The printer of claim 10, wherein the height of the gap is substantially equal to the thickness of the piece of paper.

12. The printer of claim 10, wherein when a piece of paper has a first thickness, the resilient member is elastically deformed to a first length; when another piece of paper has a second thickness greater than the first thickness, the resilient member is elastically deformed to a second length shorter than the first length.

13. The printer of claim 10, wherein the base comprises a body, a mounting bracket and a positioning portion, the mounting bracket and the positioning portion extend from a side surface of the body, and the idle roller is received between the mounting bracket and the positioning portion.

14. The printer of claim 13, wherein the resilient member is secured in a receiving space of the mounting bracket; wherein the receiving space is defined by a top wall, a bottom wall opposite the top wall, a first sidewall, and a second sidewall opposite to the first sidewall of the mounting bracket; the top wall, the bottom wall, the first sidewall, and the second sidewall extend from the side surface of the body.

15. The printer of claim 14, wherein the mounting bracket defines a sliding slot and a cutout, the cutout communicates with the sliding slot, and the movable rod is slidably received in the sliding slot through the cutout.

16. The printer of claim 15, wherein the cutout and the sliding slot communicate with the receiving space.

17. The printer of claim 15, wherein the positioning portion comprises a connecting end and a limiting end, the connecting end extends from the body, and the limiting end extends from a top portion of the connecting end; a limiting slot is defined between the limiting end and the connecting end, the movable rod is received in the limiting slot and is blocked by the limiting end from moving out of the cutout.

18. The printer of claim 13, wherein the idle roller exposes out of a top surface of the body, which is substantially perpendicular to the side surface, and the piece of paper is slid in the gap from the top surface of the body.

19. The printer of claim 10, wherein a circumferential surface of the idle roller is tangent with the opposite side of the piece of paper.

* * * * *